US006542177B1

(12) United States Patent
Bronson

(10) Patent No.: US 6,542,177 B1
(45) Date of Patent: Apr. 1, 2003

(54) LASER PRINTING SYSTEM WITH LOW COST LINEAR MODULATOR

(75) Inventor: Barry Bronson, Saratoga, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/515,460

(22) Filed: Feb. 29, 2000

(51) Int. Cl.[7] ..... B41J 2/47
(52) U.S. Cl. ..... 347/255; 347/239
(58) Field of Search ..... 347/239, 241, 347/255, 256; 358/298; 359/641, 671, 247; 345/147; 349/41, 57, 96, 104; 355/67, 32, 38; 219/121.68

(56) References Cited

U.S. PATENT DOCUMENTS 4,992,824 A * 2/1991 Plummer ..... 355/38
5,142,303 A * 8/1992 Nelson ..... 347/239
5,467,215 A * 11/1995 Lebby et al. ..... 359/247
5,589,852 A * 12/1996 Thompson et al. ..... 345/147
5,796,526 A * 8/1998 Anderson ..... 359/671
5,805,274 A * 9/1998 Saita ..... 355/38
5,808,657 A * 9/1998 Kurtz et al. ..... 347/239
5,942,136 A * 8/1999 Mori et al. ..... 219/121.68
5,949,503 A * 9/1999 Koyama et al. ..... 349/41
6,011,631 A * 1/2000 Broddin et al. ..... 358/298
6,163,363 A * 12/2000 Nelson et al. ..... 355/32
6,215,547 B1 * 4/2001 Ramanujan et al. ..... 355/67

* cited by examiner

*Primary Examiner*—Hai Pham

(57) ABSTRACT

A laser printing system for illuminating an elongate region of a photosensitive surface. The laser printing system includes a laser source to generate a light beam in a light path and a light modulation assembly that includes an n×m array of elements, wherein the n×m array has an aspect ratio of at least 1:100. The laser printing system additionally includes an expansion assembly disposed in the light path between the laser source and the light modulation assembly to expand the light beam and impinge the light beam simultaneously on substantially all of elements in the n×m array of elements.

5 Claims, 6 Drawing Sheets

LASER PRINTING SYSTEM WITH LOW COST LINEAR MODULATOR

BACKGROUND OF THE INVENTION

1. Field of the Invention

The present invention is directed generally to light modulators, and more particularly to a light modulator for spatially modulating a light beam that, without scanning, illuminates an elongate region of a photosensitive surface in a device such as a laser printer.

2. Description of the Related Art

Conventional laser printers use mechanical scanners and complex optics to scan a laser spot onto a photosensitive surface. Typical scanning optics include a multifaceted mirror that spins at high speed for scanning laser light. Such scanners require a predetermined time to spin up to operating speed prior to a first page, and the spinning speed inherently limits how fast the scanner can scan. The mechanical nature of this scanning mechanism is thus disadvantageous and also leads to increased operating noise and maintenance costs.

SUMMARY OF THE INVENTION

Briefly, a laser printing system is provided for illuminating an elongate region of a photosensitive surface. The laser printing system comprises a laser source to generate a light beam in a light path and a light modulation assembly that includes an n×m array of elements, wherein the n×m array has an aspect ratio of at least 1:100. The laser printing system additionally comprises an expansion assembly disposed in the light path between the laser source and the light modulation assembly to expand the light beam and impinge the light beam simultaneously on substantially all of the element in the n×m array of elements.

In one aspect of the present invention, the light modulation assembly comprises a liquid crystal coating over an n×m element array of substrate elements.

In a further aspect of the present invention, the elements are reflector elements.

In another aspect of the present invention, the elements are transmissive elements.

In a further aspect of the present invention, the light modulation assembly modulates the polarization of the light beam to generate a polarization-modulated light beam, and the system additionally comprises a polarization filter disposed to receive the polarization-modulated light beam from the light modulation assembly and to convert the polarization-modulated light beam to a light beam with an amplitude pattern.

In yet a further aspect of the present invention, a light directing assembly is provided for expanding the light beam received from the light modulation assembly and directing the light beam onto the photosensitive surface.

In a further aspect of the present invention, the n×m array of elements comprises elements of different shapes.

In a yet further aspect of the present invention, the elements in the n×m array of elements are interdigitated.

In a further aspect of the present invention, at least some of the light beam impinges on the n×m array of elements at an angle that is not 90 degrees.

In a further aspect of the present invention, the expansion assembly additionally comprises a polarizing beam splitter disposed to direct the expanded light beam onto the n×m array of elements at an angle of substantially 90 degrees and operating to pass light of a predetermined polarization from the n×m array of elements to the photosensitive surface.

In a further aspect of the present invention, the n×m array of elements has an aspect ratio of at least 1:1000.

In a further aspect of the present invention, the n×m array of elements has an aspect ratio of at least 1:5000.

The present invention additionally provides a method for illuminating an elongate region of a surface with a modulated illumination pattern. The method comprises forming a polarized light beam with an aspect ratio of at least 1:100, spatially modulating the light beam to generate a spatially-modulated light beam and directing the spatially-modulated light beam onto a surface.

In a further aspect of this embodiment, forming the polarized light beam comprises generating a laser light beam and expanding the laser light beam to the aspect ratio.

In a further aspect of the present invention, spatially modulating the light beam comprises impinging the expanded laser light beam on an n×m array of modulating elements having different shapes.

DETAILED DESCRIPTION OF THE PREFERRED EMBODIMENT

Figure 1:
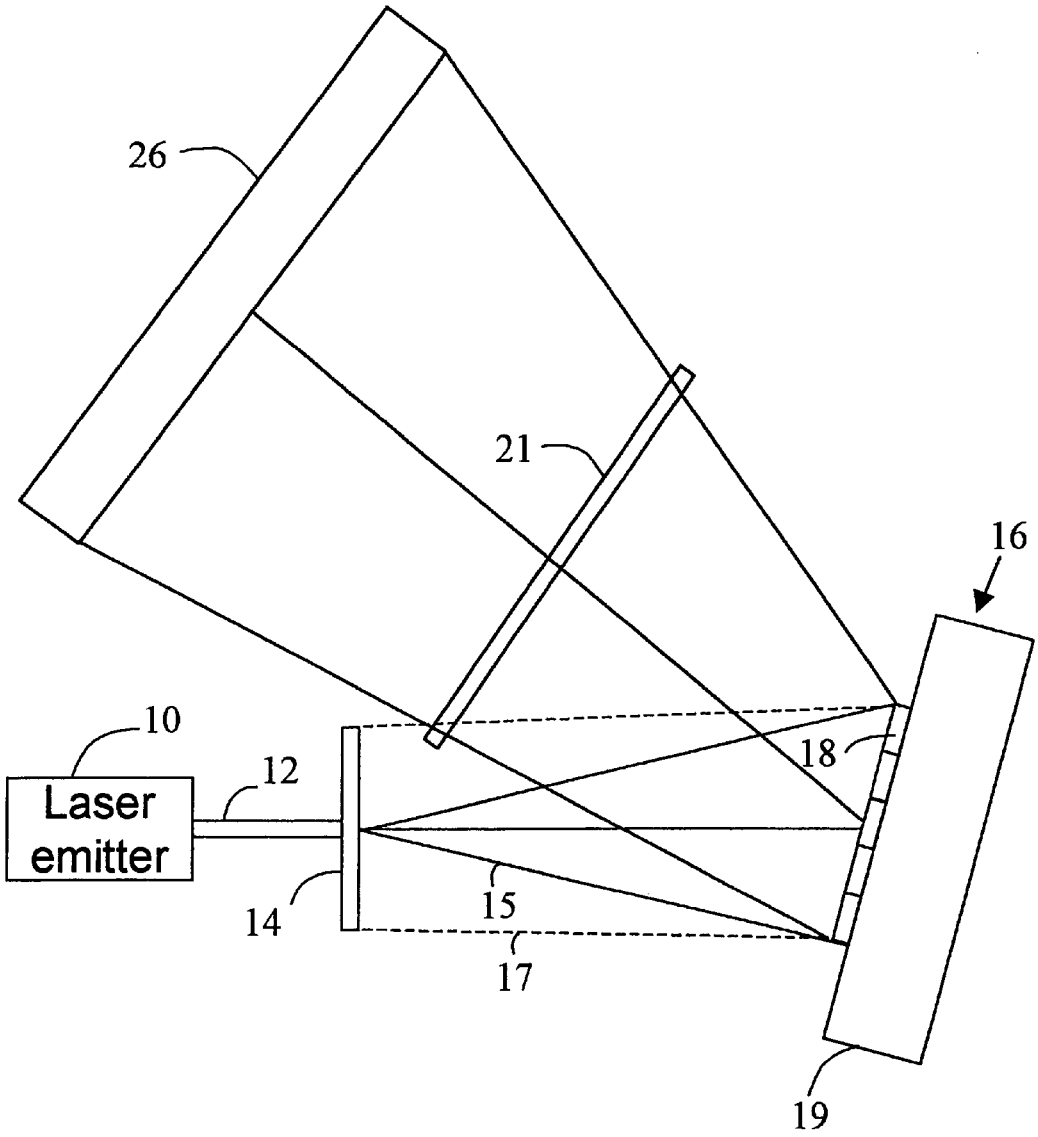
FIG. 1 is a schematic diagram of a preferred embodiment of the present invention.

Referring now to FIG. 1, there is shown a laser printing system including a laser source 10 for generating light in a light path 12. An expansion assembly 14 is disposed in light path 12 to create a high aspect ratio light beam or light swath with an aspect ratio typically greater than 1:100. The expansion assembly 14 may be implemented by a lens or other convenient optical system that causes the high aspect ratio light beam to expand with a V shape. The V-shaped beam is designated by the solid lines 15. Alternatively, the element 14 could include lenses, holographic elements or other components that generate a high aspect ratio light beam composed of a number of substantially parallel, high aspect ratio light beams. A high aspect ratio light beam composed of parallel beams of light is designated by the dashed lines 17.

The system further comprises a light modulation assembly 16 including an n×m array of elements 18 with an aspect ratio comparable to that of the high aspect ratio light beam. The high aspect ratio light beam impinges substantially simultaneously on substantially all of the elements in the n×m array of elements 18 in the light modulator 16. The light modulator 16 operates to spatially modulate the high aspect ratio light beam and to direct the resulting spatially-modulated light beam towards a photosensitive surface 26. The photosensitive surface 26 may comprise a drum or a belt or other photosensitive material for a printer or other device.

Referring more specifically to the individual elements, the laser source 10 may comprise a standard laser used for generating light of a frequency that excites the photosensitive surface 26 chosen for the system. Note that the present system may optionally be implemented with a laser with a much lower switching speed capability than the lasers used in conventional laser printers. The laser could even be on continuously during operation.

As noted above, the expansion assembly 14 may take a variety of different configurations. In the preferred embodiment shown in FIG. 1, the expansion assembly 14 expands the laser beams 12 into a high aspect ratio light beam that impinges substantially simultaneously on substantially all of the n×m array of elements. It should be noted that using an expansion assembly 14 that generates a high aspect ratio light beam 17 composed of a plurality of high aspect ratio parallel light beams may be particularly advantageous because the parallel light beams will impinge on all of the elements 18 at substantially the same angle and with substantially the same energy.

Figure 8:
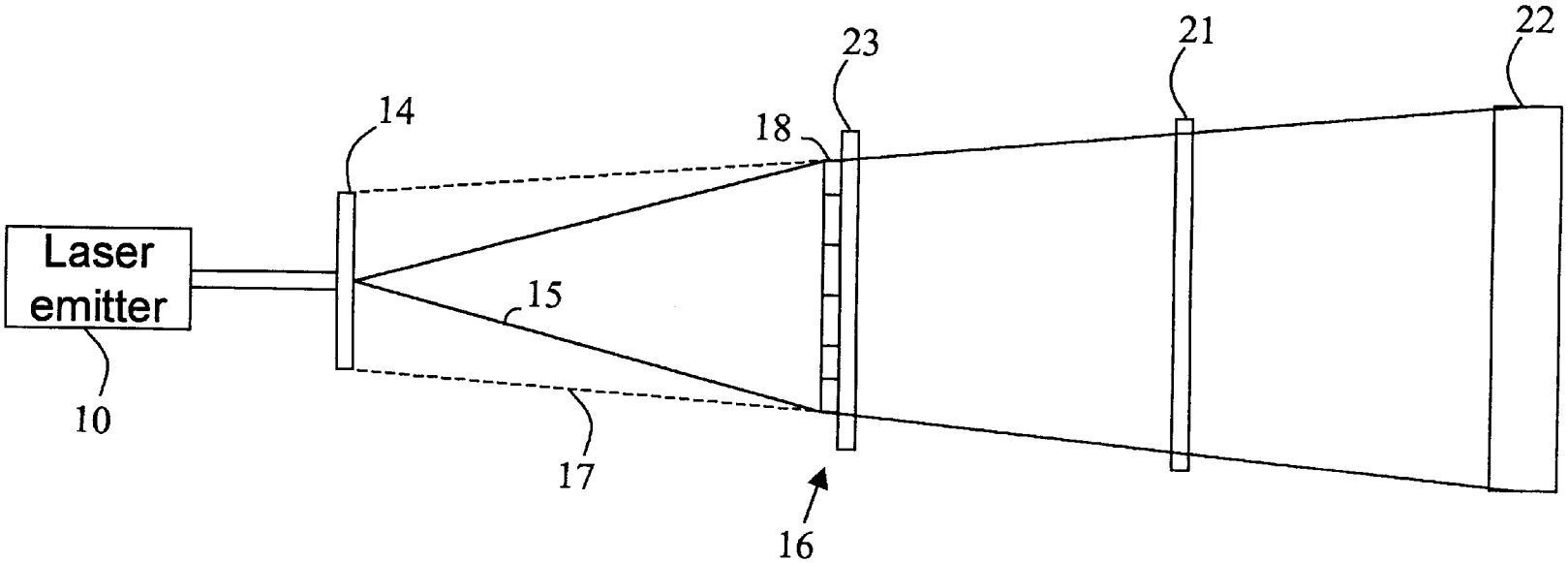
FIG. 8 is a schematic diagram illustrating another embodiment of the present invention.

The light modulation assembly 16 may be implemented by any of a variety of different elements that change one or more light transmission properties across the assembly. By way of example, the light modulator assembly 16 may comprise a modulating material or other modulating mechanism disposed over an n×m element substrate with appropriate contacts for each element. By way of example but not by way of limitation, where the light modulator assembly 16 modulates light beams that are reflected, the substrate may comprise a non-transparent silicon substrate 19 on which are located reflective elements to reflect light beams from the surface of the substrate. FIG. 1 illustrates such a reflective light modulator assembly 16. Alternatively, where light modulator assembly 16 modulates transmitted light beams, the substrate may comprise a transparent base material such as glass. FIG. 8 illustrates such a transmissive light modulation assembly 16 with a glass substrate 23.

Figure 2:
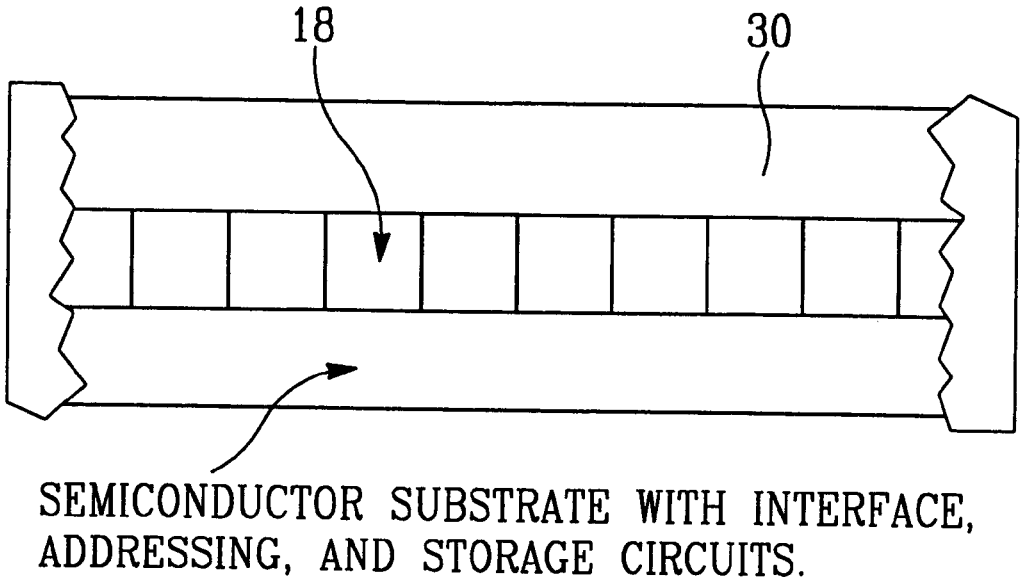
FIG. 2 is a schematic diagram of a reflective linear array for a light modulator.
Figure 3:
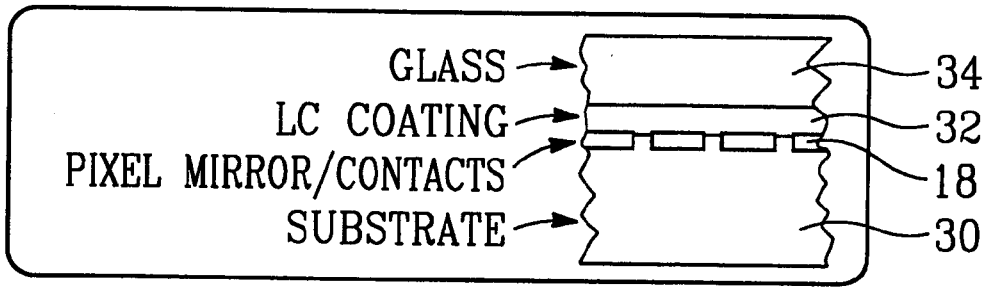
FIG. 3 is a schematic diagram of a side view of the portion of an example light modulator.

In one embodiment, the modulating material of the elements 18 may comprise a polymer dispersed liquid crystal material, or some other material that can change light transparency properties under the influence of an electric field. Such materials may be used to implement both transmissive and reflective light modulator assemblies 16, depending on the type of substrate backing, for example. Alternatively, the light modulator assembly 16 may be formed by movable micro-mirrors or other micro-machined elements in an n×m array, as shown in FIGS. 2 and 3, to be discussed below. In a preferred embodiment, the light modulator assembly 16 may be formed by a transmissive n×m liquid crystal array of nematic or ferroelectric material wherein each pixel of the array is energized with a voltage to control the polarization of the light reflected therefrom. Such materials may be used to implement both transmissive and reflective light modulator assembly embodiments, depending on the substrate backing.

It is preferred that the n×m array have a very high aspect ratio of at least 1:100, and in a preferred embodiment the aspect ratio is on the order of between 1:1000 to 1:5000. An actual modulator for a typical page-wide printer might have between 1 and 16 rows, for example, with each row having a width of from 1000 to 10,000 elements. Although a preferred embodiment would use a single light source and modulator, multiple light sources and or modulators could be used to meet specific design objectives.

It should be noted that the elements in FIG. 1 and the light path illustrated are not to scale. Additionally, the modulation assembly 16 shows a 5-element linear array for ease of illustration only. The present invention is not limited to any particular number of elements in the array.

FIG. 2 illustrates one embodiment of the light modulator assembly 16. This Figure shows a top view of a reflective linear array 18 disposed in a semiconductor substrate 30. The semiconductor substrate 30 would contain the interfacing layers, addressing lines, control lines and storage circuits as appropriate (not shown) and as are well known in the art.

Referring to FIG. 3, there is shown a side view of the light modulator of FIG. 2. It can be seen that this embodiment of the light modulator assembly includes the pixel mirror/contacts 18 which may be energized to either reflect or block light in the optical path. The pixel elements 18 are disposed in the silicon substrate 30. Note that the interfacing levels, the addressing lines, the control lines, and the storage circuits are not shown in FIG. 3 for convenience of illustration. The light modulator assembly 16 in the embodiment shown in FIG. 3 further includes a liquid crystal coating 32, which in a preferred embodiment may be implemented by a one micron-thick ferroelectric liquid crystal coating. Disposed over the liquid crystal coating 32 is a layer of glass 34. In this embodiment, the elements control the light polarization state of the liquid crystal coating over the silicon substrate.

Note that if the light modulator assembly 16 is implemented by a modulator that modulates the polarization of the light, for example by using nematic material or ferroelectric material, then a filter would need to be added in order to convert the polarization modulation to a light amplitude pattern. In this regard, a polarization filter 21 is shown in FIG. 1 as an optional element that would be included to convert the polarization modulation to a light amplitude pattern when such a polarization modulator assembly 16 is used. The polarization filter 21 could be a standard polarizing beam splitter that will transmit light of one polarization, while reflecting light of the opposite polarization.

It should be noted that the light modulation assembly 16 may include a single line of elements 18, i.e., a 1×m array, or multiple lines of elements 18, i.e., an n×m array, where the aspect ratio is high, as noted previously. Additionally, the light modulation elements 18 can have customized shapes, including customized aspect ratios, to optimize image quality and photon throughput. By way of example, customized pixel shapes can be chosen in the system design phase to compensate for the anomalies in the optics for that particular system layout, and then implemented, by way of example, by standard masking manufacturing techniques. Typical shapes that might be chosen include a round shape, an oval shape, and shapes with a variety of different aspect ratios such as a square shape, or an aspect ratio of one-to-three. Moreover, the rows of pixels could be staggered.

Figure 4:
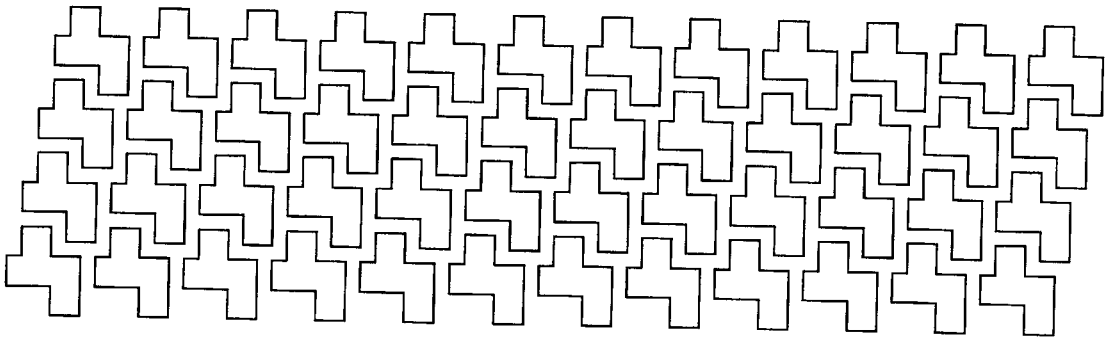
FIG. 4 is a schematic diagram of an interdigitated hatch pattern of pixels.
Figure 5:
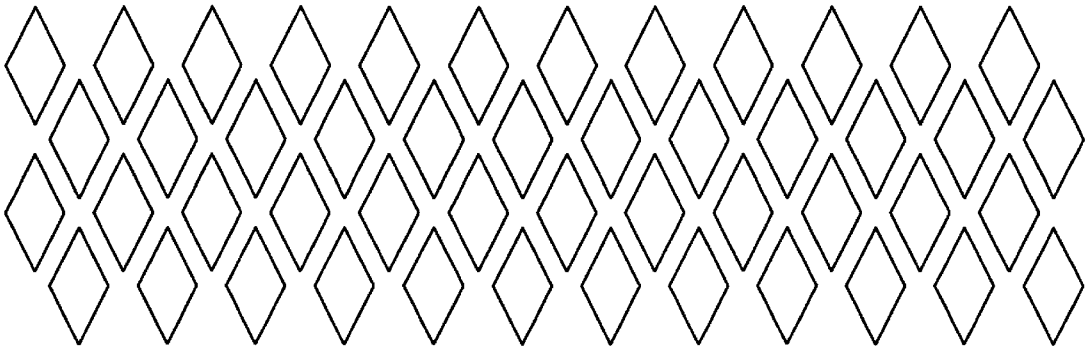
FIG. 5 is a schematic diagram of an interdigitated diamond pattern of pixels.

Additionally, an overlap or interdigitation of elements could be created to avoid raster problems on finished prints. FIG. 4 shows an interdigitated hatch pattern of pixels. FIG. 5 shows an interdigitated diamond pattern of pixels. A variety of other interdigitated pixel patterns, such as honeycomb patterns could be used.

Alternatively, instead of shaping the individual element, elements could be created by a plurality of subelements, which can be grouped dynamically by selective energization in order to obtain particular desired element shapes. Typically, the light would be defocused at the subelement level.

Accordingly, each pixel can be "shaped" to compensate for distortion in the optics design. As noted, almost any shape can be obtained. Adjacent elements 18 can be interdigitated horizontally. If multiple rows of elements 18 are present, these elements can also be interdigitated vertically. The result of this shaping of pixels is to produce various smoothing and/or blending effects in text, graphics and images.

Additionally, modulation of the elements 18 can be used for gray scale control. Such modulation for gray scale control might comprise varying the length of time that various pixels in a particular area are energized, i.e., some of the pixels in a grouping can be energized for 50 percent of a time interval while others can be energized for 75 percent of a time interval, etc. Accordingly, optical distortions in the system can be compensated at the specific point where the distortions are appearing on the photosensitive surface 26.

Figure 6:
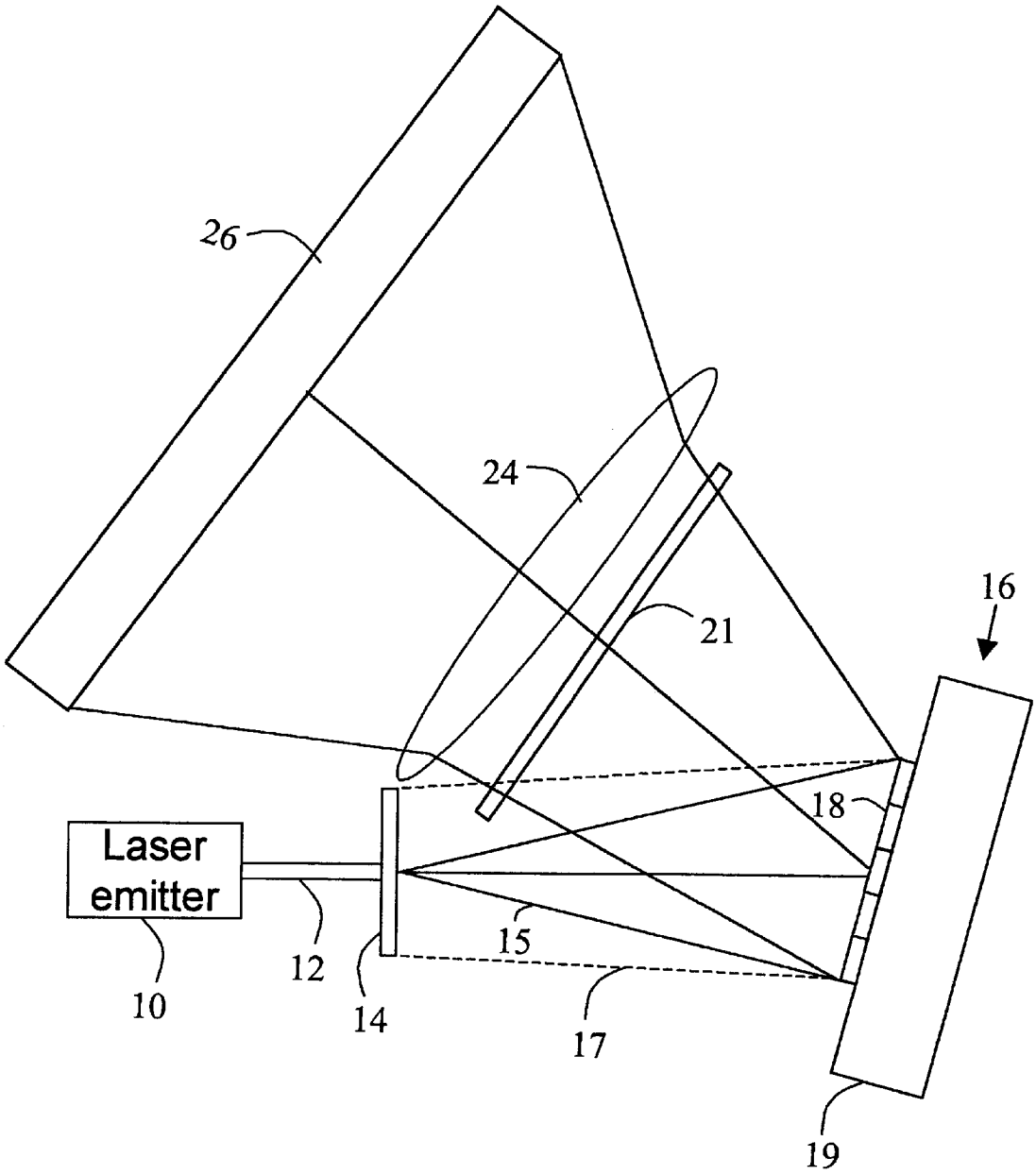
FIG. 6 is a schematic diagram of a second embodiment of the present invention.

FIG. 6 discloses a second embodiment of the present invention that includes a light directing assembly 24. The light directing assembly 24 may comprise an element for optically expanding the beam width of the light beam reflected or transmitted from the light modulation assembly 16 to cover a large photosensitive surface 26. By way of example, the light directing assembly may be implemented by a lens 21 to cover the desired area of the photosensitive surface 26. Additionally, one or more mirrors (not shown) could be added to the light directing assembly 24 after the light modulation assembly 16 to widen the swath of light from the light modulator assembly 16 before reaching the photosensitive surface 26.

By way of example, but not by way of limitation, a 600 dpi print resolution along an 200 mm wide path on the photosensitive surface 26 and light modulator assembly 16 with an array of elements 18 about 25 mm long would result in a pixel spacing of five microns. This pixel spacing is feasible with present-day fabrication and assembly techniques.

Figure 7:
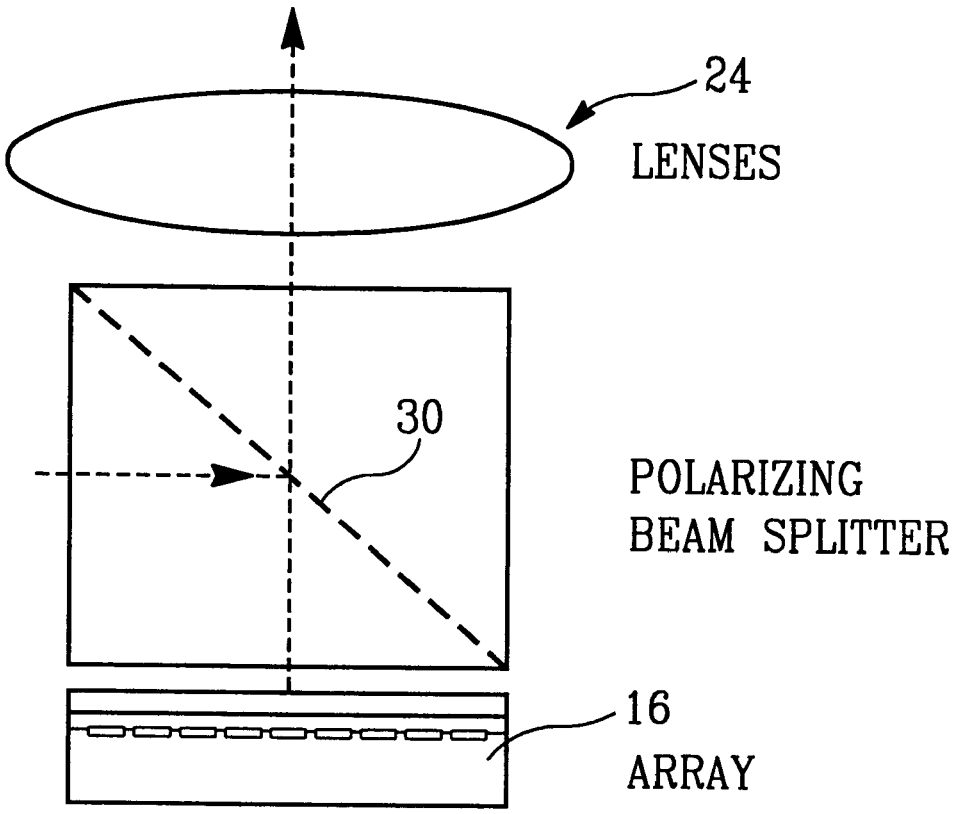
FIG. 7 is a schematic diagram illustrating an on-axis embodiment of the present invention.

It should be noted that the embodiment of the invention shown in FIG. 1 is an off-axis design. In contrast, FIG. 7 illustrates the portion of the design that would change in order to implement an on-axis design. In this embodiment, the high aspect ratio light beam from the expansion assembly 14 impinges on a polarizing beam splitter 30 set at 45 degrees to the incoming light beam from the expansion assembly. The polarizing beam splitter 30 directs the high, aspect ratio light beam to impinge at a 90 degree angle onto the light modulation assembly 16, where the light will be polarization modulated and reflected back toward the polarizing beam splitter. The polarizing beam splitter 30 will reflect light polarized in one direction back to the light source, while transmitting light of the opposite polarization therethrough to the light directing assembly 24, which operates in the same way as disclosed previously.

As noted above, FIG. 8 illustrates an embodiment where the light beams are modulated as they are transmitted through the light modulation assembly 16. Note that the angle at which the light beams impinge on the light modulation assembly 16 may be orthogonal to the plane of the light modulation assembly or at some other convenient angle.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and their equivalents.

I claim:

1. A laser printing system for illuminating an elongate region of a photosensitive surface, the system comprising:

a laser source to generate a light beam in a light path, but containing no structure for scanning said light from said laser source;

a light modulation assembly including an n×m array of elements, wherein said n×m array has an aspect ratio of at least 1:100, and wherein said n×m array of elements comprises a liquid crystal coating over an n×m element array of reflective substrate elements on a semiconductor substrate; and an expansion assembly disposed in said light path between said laser source and said light modulation assembly to expand said light beam and impinge said light beam simultaneously on substantially all of said n×m array of elements;

wherein said n×m array of elements comprises elements of different shapes.

2. A printing system as defined in claim 1, wherein said expansion assembly additionally comprises a polarizing beam splitter disposed to direct said expanded light beam onto said n×m array of elements at an angle of substantially 90 degrees and operating to pass light of a predetermined polarization from said n×m array of elements to said photosensitive surface.

3. A printing system as defined in claim 1, wherein said n×m array of elements has an aspect ratio of at least 1:1000.

4. A printing system as defined in claim 1, wherein said n×m array of elements has an aspect ratio of at least 1:5000.

5. The system as defined in claim 1, wherein said elements in said n×m array of elements in said light modulation assembly are interdigitated with substantially no gaps therebetween.

* * * * *